US007866512B2

(12) United States Patent
Fertig

(10) Patent No.: US 7,866,512 B2
(45) Date of Patent: Jan. 11, 2011

(54) CONTAINER SYSTEM

(75) Inventor: Volker Fertig, Wertheim-Nassig (DE)

(73) Assignee: Lutz Pumpen GmbH, Wertheim (DE)

( * ) Notice: Subject to any disclaimer, the term of this patent is extended or adjusted under 35 U.S.C. 154(b) by 941 days.

(21) Appl. No.: 11/663,494

(22) PCT Filed: Aug. 24, 2005

(86) PCT No.: PCT/DE2005/001472

§ 371 (c)(1),
(2), (4) Date: Mar. 22, 2007

(87) PCT Pub. No.: WO2006/032231

PCT Pub. Date: Mar. 30, 2006

(65) Prior Publication Data

US 2009/0212076 A1 Aug. 27, 2009

(30) Foreign Application Priority Data

Sep. 22, 2004 (DE) ..... 10 2004 046 224
Sep. 22, 2004 (DE) ..... 10 2004 046 266

(51) Int. Cl.
*B67D 7/06* (2010.01)

(52) U.S. Cl. ..... 222/183; 222/143; 222/333; 222/383.2; 222/385; 417/360; 417/423.15

(58) Field of Classification Search ..... 222/143, 222/183, 333, 375, 383.1, 383.2, 385; 417/360, 417/423.15, 424.1; 220/601, 626
See application file for complete search history.

(56) References Cited

U.S. PATENT DOCUMENTS 1,908,707 A * 5/1933 Kramer ..... 222/385
1,930,293 A * 10/1933 Valentine ..... 222/318
2,385,105 A 4/1944 Samelson (Spec)

(Continued)

FOREIGN PATENT DOCUMENTS

DE 85 15 779.1 8/1985

(Continued)

OTHER PUBLICATIONS

International Search Report, Dec. 13, 2005.

*Primary Examiner*—Kevin P Shaver
*Assistant Examiner*—Daniel R Shearer
(74) *Attorney, Agent, or Firm*—Collard & Roe, P.C.

(57) ABSTRACT

The invention relates to a container system comprising a container with an integrated pump mechanism of a submersible pump, particularly a drum pump or a container pump with a pump lance. This pump lance can be inserted into the container via a bunghole, and a rotor shaft, which has a pump rotor mounted thereon in a rotationally fixed manner and which is actively connected to a drive motor, extends through the pump lance. By virtue of the fact that the submersible pump has a pump head and a pump mechanism, which are designed so that they can be separated from one another, and a withdrawal connection is assigned to the pump head that can be removed from the pump mechanism, the invention ensures that the container, which is advantageously provided with a bunghole that is drawn deeper or is otherwise situated lower, forms, together with the pump mechanism integrated in the container, a stackable and transportable unit that can be sealed tightly. The invention is for use in SCR technology or AdBlue® technology.

31 Claims, 4 Drawing Sheets

U.S. PATENT DOCUMENTS

Figure 1:
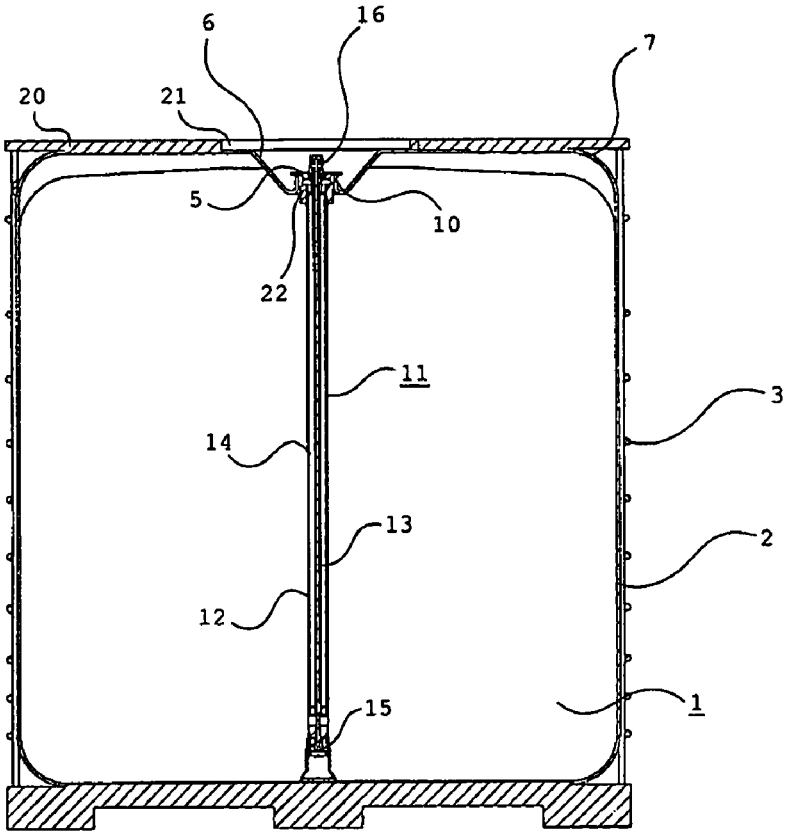

| | | | | | |
|---|---|---|---|---|---|
| 2,362,922 | A | * | 11/1944 | Palm | 417/201 |
| 2,623,469 | A | * | 12/1952 | Gray | 417/310 |
| 2,843,048 | A | * | 7/1958 | Tapp | 415/199.2 |
| 3,151,565 | A | * | 10/1964 | Albertson et al. | 415/190 |
| 3,207,078 | A | * | 9/1965 | Cook | 418/225 |

FOREIGN PATENT DOCUMENTS

| | | | |
|---|---|---|---|
| DE | 35 40 025 | | 5/1987 |
| DE | 41 41 774 | | 7/1993 |
| DE | 43 35 242 | A1 | 4/1995 |
| EP | 0 196 471 | A | 10/1986 |
| EP | 0 856 488 | A | 8/1998 |
| FR | 2 672 279 | A | 8/1992 |

* cited by examiner

CONTAINER SYSTEM

CROSS REFERENCE TO RELATED APPLICATIONS

Applicant claims priority under 35 U.S.C. §119 of German Application No. 10 2004 046 224.0 filed Sep. 22, 2004 and German Application No. 10 2004 046 266.6 filed Sep. 22, 2004. Applicant also claims priority under 35 U.S.C. §365 of PCT/DE2005/001472 filed Aug. 24, 2005. The international application under PCT article 21(2) was not published in English.

The invention relates to a container system having a pumping mechanism of a container pump, particularly a barrel pump or container pump, integrated into a container, which mechanism has a pump lance that can be introduced into the container through a tap hole, through which lance a rotor shaft standing in effect connection with a drive motor, having a pump rotor accommodated on the shaft so as to rotate with it, extends, whereby the pump rotor is disposed at the end that is removed from the drive side of the rotor shaft, therefore is disposed in the bottom region of the container when disposed in accordance with its purpose, and having a pump head that can be separated from the pumping mechanism, having an integrated drive motor.

Such a container system is previously known from DE 43 35 242 A1.

Furthermore, a container pump of the type described is previously known from U.S. Pat. No. 2,385,105. This involves a container pump that can be connected with a container by means of a screw connection. In this connection, a structure in four different planes becomes clear, which are also screwed together, forming a seal. Because of the intermeshing of the individual planes, it becomes clear that separation of the pump head from the pumping mechanism is at most to be carried out for repair purposes.

Another container pump is described by DE 85 15 779.1. The object of this utility model is a connector piece for a pump, particularly a barrel pump, which is connected with a container, as a whole, forming a seal. The connection is implemented in the form of a bayonet closure, which is easy to open, so that the pump, together with its pumping mechanism, can easily be separated from the container.

It is furthermore known to use such container pumps for emptying returnable transport containers, particularly so-called "IPC containers." Such containers usually consist of an accommodation vessel made of plastic, particularly of polypropylene. These accommodation vessels usually have a rectangular or square cross-section. In order to increase the transportability and the reinforcement of the plastic walls, but also in order to assure the stackability of the said containers, the plastic vessels in question are usually surrounded with a wire grid that engages around the plastic containers in supporting manner.

Such containers can now be emptied by means of a pressure feed or suction feed, according to DE 41 41 774 A1. Alternatively, the containers can also be emptied by means of the container pumps mentioned above. In this connection, a pump lance is usually introduced into the container through the tap hole of the container, and a fluid accommodated in the container and to be transported is conveyed through a transport channel concentrically disposed in the pump lance, by means of the pump rotor disposed at the end of the pump lance that is removed from the drive motor, and passed into a hose line connected to a removal connector piece, by way of this removal connector piece, by way of which line the fluid can be removed from the aforementioned container.

In particular within the framework of the introduction of the so-called "SCR technology," the need has arisen, particularly at large shipping companies, to keep reduction agents, preferably agents that are transported in the aforementioned IPC containers, on hand in the sector of the shipping company's own gas stations or also at independent gas stations. The term SCR technology (Selective Catalytic Reduction) describes a technology for reducing the amount of nitrogen oxide emissions ($NO_x$) in exhaust gas, by means of the use of a reduction agent and of catalysts, allowing usage-optimized engine operation, particularly of diesel engines. In this connection, the reduction agent, preferably urea, is catalytically or thermally converted to ammonia, and then used, in combination with suitable catalysts, to convert nitrogen oxides into harmless nitrogen and water. According to the current state of the art, the SCR technology is considered to be the method for nitrogen oxide reduction that has been furthest developed. It is considered to be certain that $NO_x$ conversion rates of 75 to 85% can be implemented with this SCR technology. Furthermore, the HC and PM values of the exhaust gases, which are also considered to be harmful to the environment, are drastically reduced. It is considered to be certain that the legislature will prescribe the introduction of the SCR technology, at least for utility vehicles.

It will therefore be necessary in the future for the utility vehicles in question to carry not only fuel but also the aforementioned reduction agents, in other words particularly urea, in order to use the catalyst technology explained above. Tanks of the utility vehicles must therefore also be filled with urea, in the future.

The said technology is also called "AdBlue technology." As described above, the establishment of an AdBlue infrastructure is also necessary for area-wide introduction of this technology.

In this connection, it can be assumed that the reduction agents will be supplied to shipping companies and gas stations in the aforementioned IPC tanks. In this connection, complete sealing of the containers and of the fluids accommodated in these containers must be required already during transport, as well as when filling the tanks of the trucks with the reduction agent, because the urea accommodated in these containers crystallizes out under atmospheric conditions.

The solution provided up to now in this regard, that the container is already provided with a suction lance at the plant, and then emptied at the shipping company by means of connecting a suction hose with a suction pump, already has problems inherent in it with regard to the seal to be demanded in this regard. Furthermore, the lifetime of the so-called suction pumps is comparatively low in comparison with the barrel pumps described above, since the self-priming pump necessarily runs dry at least at the time it is turned on, but also when the container has been emptied, whereby this phase of dry running means increased pump wear and therefore a lower life expectancy for these pumps.

It is true that the possible immediate alternative to the use of the barrel pumps described above, in the sector of the containers in question, for example their fixed installation or fixed connection with the container, represents an alternative to emptying of the containers with a suction lance, as explained above, that should be considered and is doable. The use of this technology has the disadvantage, however, that the removal connector piece described above must necessarily be disposed outside of the tap hole. This also holds true for the drive motor, which is usually disposed above the removal connector piece. In this connection, the arrangement of the down-flow connector piece and of the drive motor above the tap hole is equivalent to the loss of stackability for the containers intended for transport of the reduction agent.

Proceeding from this state of the art, the invention is therefore based on the task of creating a container system that meets the requirements concerning the constant sealing of the fluid accommodated in the container, on the one hand, and maintains the stackability of the containers, at least to a great extent, and furthermore can be equipped with a more powerful emptying device.

The solution for this task is accomplished with a container system in accordance with the characteristics of the main claim, as well as the characteristics of the secondary claim 12. Advantageous embodiments can be derived from the dependent claims.

According to the main claim, the core idea of the container system according to the invention lies in using a container pump having a pump head and a pumping mechanism that can be separated from one another. The separability of the drive unit adapted as a pump head from the pumping mechanism as such has already been implemented in the state of the art. The particularity of the solution according to the invention now lies in the fact that in contrast to the state of the art, the removal connector piece for connecting a pressure hose for emptying the container is also assigned to the pumping mechanism, in a connector flange for connecting the pump head to the pumping mechanism. In this way, it is possible to structure the pumping mechanism in such a manner that only the connection connector piece required for connecting the pump head projects above the tap hole of the container. In this way, it is possible, in turn, to deliver the containers described, if the tap hole is drawn correspondingly deeper, with the pumping mechanism already integrated into them, whereby the connection connector piece of the pumping mechanism for the pump head also remains below the upper container edge, and therefore it is assured that the stackability of the containers provided with the pumping mechanism is not impaired.

In this connection, in an advantageous embodiment, the pumping mechanism accommodated in the container forms a sealed system with the container. This is particularly necessary and practical under the aspect that the fluids that are preferably accommodated in the container can be impaired under the influence of atmospheric pressure or other ambient influences. In the present case, it had been particularly pointed out that the urea to be transported in the container crystallizes out under the influence of atmospheric pressure.

The pump head is usually coupled with the connection connector piece of the pumping mechanism by way of a connector flange or by means of a bayonet closure, whereby in this connection, the drive motor enters into an effect connection with the rotor shaft and furthermore, a sealed flow connection between the removal connector piece and the transport channel concentrically disposed in the pump lance of the pumping mechanism is produced.

In another advantageous embodiment, the removal connector piece, in contrast to the state of the art, is disposed not at an essentially right angle to the longitudinal axis of the pump lance, but rather at a slant, diagonally, so that with an unchanged length of the removal connector piece, the space requirement for the removal connector piece is less in the radial direction, extending away from the imaginary longitudinal axis of the pump lance. This slanted arrangement of the removal connector piece has the advantage that the removal connector piece is disposed more or less completely in the depression of the tap hole, so that any pressure hose connection that might be required can be simply installed on the removal connector piece, for one thing, and for another thing, the aforementioned hose connection does not have to be bent, perhaps because the dimensions of the depression of the tap hole require this. Such a bend would reduce the durability of the removal hose, for one thing, and for another thing, would impair the feed performance of the container pump, if applicable.

In an advantageous embodiment, the tap hole is drawn deeper relative to the upper edge of the container wall, in such a manner that the connection connector piece of the pumping mechanism remains below the upper edge of the container, in each instance. Drawing the tap hole deeper therefore supports the aim of the solution according to the invention to impair the stackability of the container as little as possible, best of all not at all, in an advantageous embodiment.

Often, the IPC containers are also configured with double walls, so that in an alternative embodiment, the outer container wall, in each instance, can also be drawn higher, so that the upper container edge is essentially laid higher, and projects above the tap hole let into the inner container wall, with the integrated pumping mechanism.

In both cases, the tap hole has been drawn deeper, in such a manner that also the removal connector piece, which is disposed in the connector flange of the pump head in such a manner that the latter also does not project above the upper edge of the container to be emptied.

In another advantageous embodiment, the drive motor can also be configured to be separable from the connection connector piece, in order to be able to replace the drive motor as such without problems in case of a break-down, for example. Since the removal connector piece is disposed below the upper container edge, the containers can be delivered with the connector flange already sitting on them, without thereby impairing the stackability of the containers.

The container pump described above is ideally operated with a conventional universal motor.

In another advantageous embodiment, the coupling of the connector flange is designed in such a manner that when the connector flange, and with it the pump head, are connected to the pumping mechanism, the seal provided for closing the sealed system formed by the pumping mechanism and the container is automatically opened, and in this way, the flow channel is opened in the direction of the removal connector piece.

In an advantageous embodiment, a conventional tap gun can be connected with the removal connector piece.

In another advantageous embodiment, a flow-through counter is switched in the hose connection between tap gun and removal connector piece.

The removal connector piece is additionally provided with a back-flow lock to prevent possibly contaminated fluid from flowing back into the container after the end of the tapping process.

The sealed system "container with integrated pumping mechanism" is delivered with a lead seal, in an advantageous embodiment, in order to thereby allow a filling level control and guarantee.

According to the secondary claim 12, the container to be emptied can already be delivered as a completely sealed unit, because of the circumstance that the pumping mechanism is structured to be removable from the pump head. This is possible in that the pump lance is already introduced into the tap hole of the container in the plant, and surrounded by a suitable sealing body in the region of the tap hole, forming a seal. On the basis of the, solution according to the invention, it is therefore possible to deliver such containers, as a complete unit, to the location of emptying, whereby the pump head is only connected with the integrated drive unit on site, in order to perform emptying of the container on site. This is of interest in connection with the introduction of the SCR technology. The introduction of this technology represents an example for a possible use of containers structured in this manner.

The solution according to the invention, in accordance with the characteristics of the secondary claim 12, can certainly be used in combination with the solution according to the main claim. However, it is also easily possible to equip a container with only one of the two solutions.

In a concrete embodiment, the sealing body has at least one O-ring seal that lies on the inside. In this connection, the sealing body is introduced by a pressure spring that engages below the sealing body on the rotor side, preferably a helical spring, against a circumferential bevel of the connection connector piece of the pumping mechanism introduced into the tap hole of the container, which bevel also runs on the rotor side, so that the said O-ring seal that lies on the inside closes off a flow channel opened approximately between the connection connector piece and the sealing body that surrounds the connection connector piece, forming a seal. In the sense of redundancy, it can be advantageous to provide two O-ring seals that lie on the inside at this location.

In an advantageous further development, the sealing body is additionally provided with at least one O-ring seal that lies on the outside, which closes off a possible flow channel between the interior of the tap hole and the sealing body itself, forming a seal.

The introduction connector piece of the connection connector piece of the pumping mechanism is screwed onto the tap hole by means of a conventional screw thread, in that a screw flange engages over the tap hole wall that is provided with a screw thread, on the outside. In this connection, the introduction connector piece is screwed onto the tap hole of the container with the interposition of a sealing ring. At this location, as well, a secure seal of the container with regard to the outside environment is therefore guaranteed.

It is advantageous if the rotor shaft guided in the pump lance is surrounded by a shaft guide tube, whereby the shaft guide tube is disposed essentially concentrically in the pump dome of the container pump. The pump dome represents the flow channel for the fluid to be conveyed out of the container, in order to convey the fluid through the pump dome to a removal connector piece. For this reason, the pump dome necessarily extends through the entire pump lance and the connection connector piece of the pumping mechanism that follows it in the flow direction, whereby the pump dome is closed off by the aforementioned sealing body on the drive side.

In a particularly advantageous embodiment, the pump foot is configured without a seal, to a great extent. It is known that every seal has the disadvantage of losing its sealing effect sooner or later, for example due to the wear that occurs as a result of its operation, or at least of acting only with a reduced effect. In this connection, there is the fundamental problem in connection with the said container pumps that the rotor shaft that goes through from the drive side all the way to the pump rotor is guided in a shaft guide tube, and that this shaft guide tube at first represents another flow channel for the fluid accommodated in the container, which might lead to undesirable leakage, if applicable. For this reason, the rotor shaft is usually sealed, on the drive side, by means of a slide ring seal, or the rotor shaft is mounted in a tap bushing, in order to thereby prevent the undesirable passage of the fluid through the aforementioned shaft guide tube, in the drive direction. The solution according to the invention intentionally does without such a seal, at least in the region of the pump foot.

This is possible, according to claim 7, in that the pump foot is separated, relative to the pump dome, by means of a so-called closure body, at first, whereby the closure body is necessarily penetrated by the rotor shaft. In this connection, the rotor shaft is mounted, in the region of this closure body, by means of a slide bearing, whereby the bearing bushing is dimensioned, in terms of length and diameter, in such a manner that a fluid that might rise along the rotor shaft becomes pressureless over the length of this bearing bushing, whereby the fluid thereby exiting from the bearing bushing in pressureless manner gets into exit channels that run essentially horizontally and radially outward, which guide the leakage fluid back into the pump foot or into the fluid that surrounds the pump foot. Since the leakage fluid that rises along the rotor shaft has been drained away in this manner, a further passage of fluid through the shaft guide tube, due to pump operation, is precluded, to a great extent. However, in order to guide the fluid to be emptied through the closure body into the pump dome, as intended, flow channels that are disposed essentially vertically are disposed in the closure body, in addition to the passage for the rotor shaft, through which the fluid to be conveyed is driven out through the closure body, into the pump dome, in the direction of the removal connector piece, as intended, during operation of the container pump.

Without prejudice to the solution described above, however, there is the problem that the fluid level in the shaft guide tube will usually correspond to the fluid level in the container. Since it is certainly desirable, in order to maintain the stackability of the containers, to draw the tap hole of the containers lower in such a manner that the connection connector piece of the pumping mechanism accommodated in the tap hole, for subsequent connection of the pump head, does not project above the upper container wall, in each instance, there is the problem that if the containers are filled "above level" in the plant, the fluid that is present in the shaft guide tube in the region of the connection connector piece is not pressureless. In this regard, it has proven itself to seal the shaft guide tube, on the drive side, with at least one additional shaft seal in the region of the connection connector piece, towards the drive side.

For the reason stated above, it is additionally recommended if the sealing body that surrounds the rotor shaft that is also guided through the connection connector piece is sealed off, in the region of the connection connector piece, with at least one, preferably two shaft sealing ring(s), towards the drive side.

Now that secure sealing of the container in the transport phase is guaranteed on the basis of the above characteristics, it must also be assured that the seal is maintained at all times of connection of the pump head to the pumping mechanism, and that subsequently, the pumping mechanism represents a completely sealed unit with the pump head and the container.

This is possible in that at first, in advantageous manner, the removal connector piece for connecting a pressure hose is not disposed in the region of the pumping mechanism, but rather assigned to the connector flange. The removal connector piece is therefore only set onto the connection connector piece of the pumping mechanism at the time of connection of the connector flange of the pump head. In this connection, the connector flange is pressed onto the removal connector piece and the tap hole, and thereby the sealing body is pressed downward, overcoming the spring force of the pressure spring that engages under the sealing body on the rotor side, and therefore the O-ring seal of the sealing body that lies on the inside is put out of engagement, and the flow channel from the pump dome of the pumping mechanism is opened in the direction of the removal connector piece integrated into the connector flange, as intended. In this region, the O-ring seal that lies on the outside now takes over the task of surrounding the introduction connector piece and the connector cuff of the connector flange, forming a seal, in such a manner that a flow channel that is opened between the connector cuff of the connector flange of the pump head and the introduction connector piece of the connection connector piece of the pumping mechanism is and remains closed off, forming a seal.

Now that the pump dome is opened towards the drive side, as already mentioned, it must be assured that the flow channel opened up in this manner continues to be opened up towards the removal connector piece, and not possibly towards the drive side. In this connection, it has proven itself to provide at least one additional outside O-ring seal in the region of the ball bearing of the rotor shaft, which reliably closes off the possible leakage channel.

The connector flange of the pump head is usually set onto the connection connector piece of the pumping mechanism in simple manner, by means of a bayonet closure, whereby with the connection of the connector flange of the pump head onto the pumping mechanism, not only does a force-fit connection of the drive unit with the rotor shaft of the pumping mechanism exist, but also a flow connection from the pump dome of the pump foot to the removal connector piece of the connection connector piece is opened up, which is otherwise completely sealed.

In the following, the invention will be presented in greater detail using an exemplary embodiment shown only schematically in the drawing.

Figure 2:
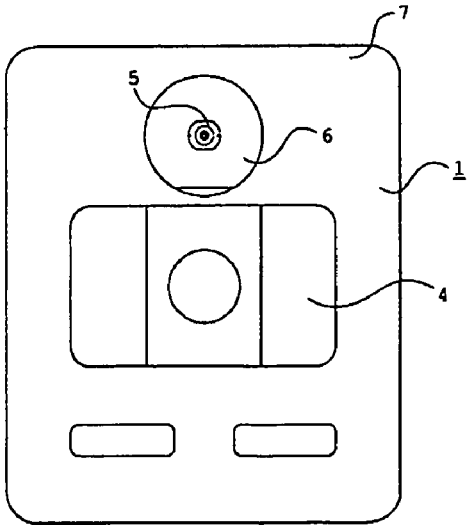
Figure 3:
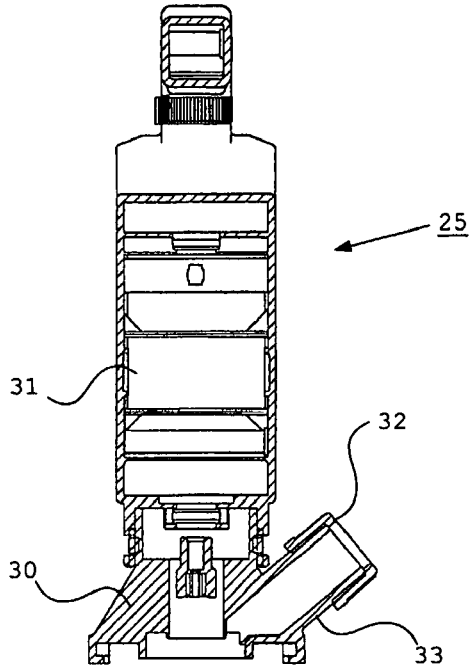
Figure 4:
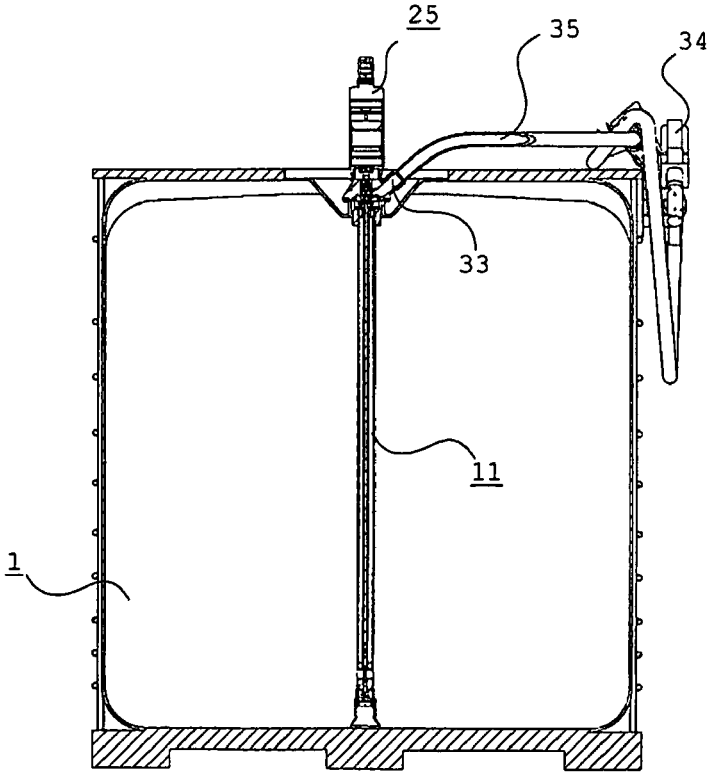
Figure 5:
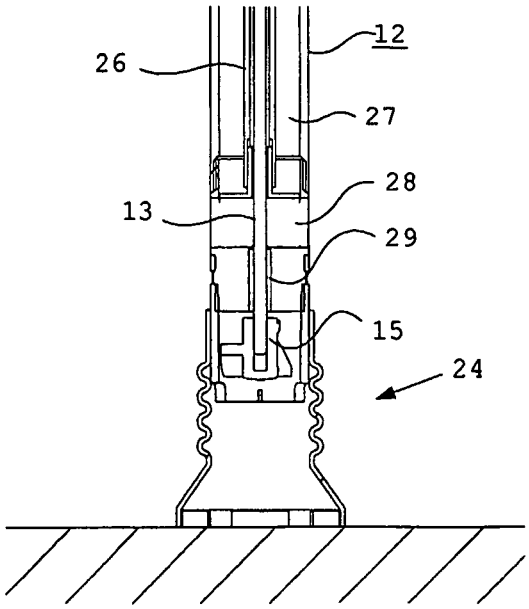
Figure 6:
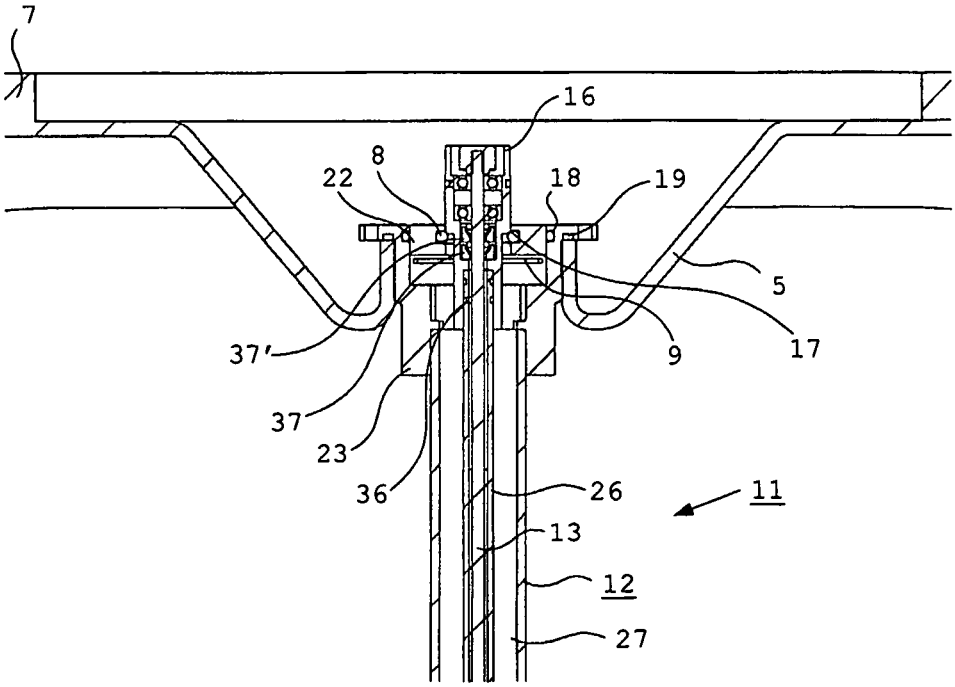
Figure 7:
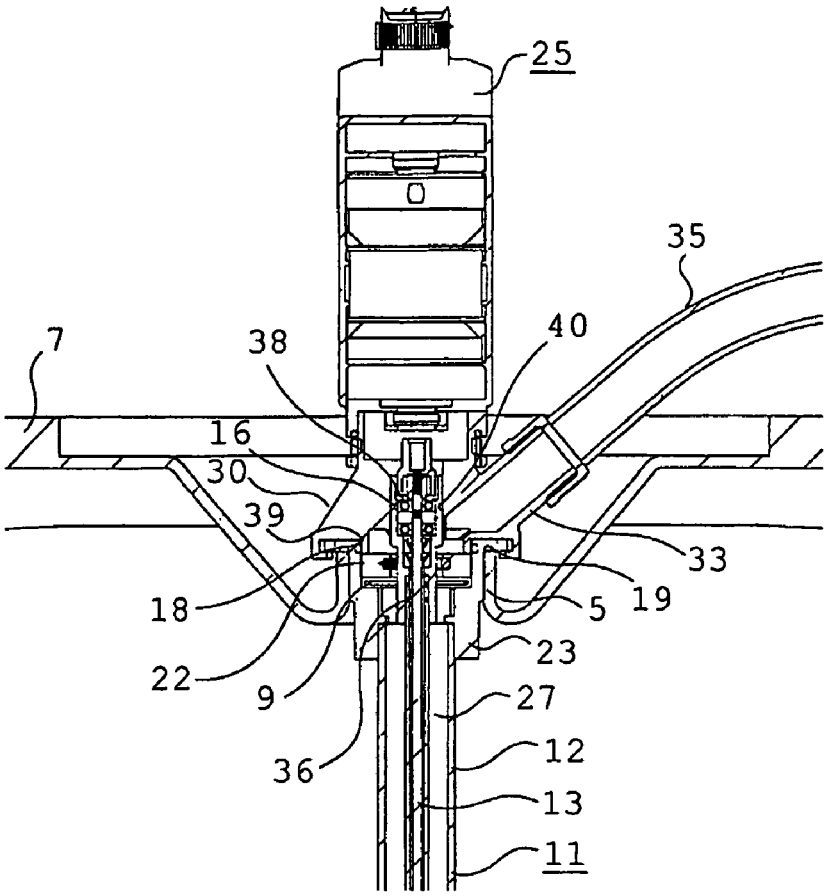

This shows:

FIG. 1 a container having a pumping mechanism accommodated in a tap hole of the container, in a sectional view;

FIG. 2 a top view of the container shown in FIG. 1;

FIG. 3 a pump head in a sectional view;

FIG. 4 a complete view of the container system with a completely installed container pump disposed in the container, in a sectional view;

FIG. 5 the pump foot of the container pump shown in FIG. 4, in a sectional view;

FIG. 6 the connection connector piece of the pumping mechanism of the container pump shown in FIG. 4, in a sectional view, and FIG. 7 the connection connector piece of the pumping mechanism shown in FIG. 6, with the connector flange of the pump head set on, in another sectional view.

FIG. 1 shows a container, particularly an IPC container such as that usually used for the transport of chemical, pharmaceutical, or other fluids, which are used in the industrial sector. Such containers have a capacity of approximately 1000 liters. The container wall 2, usually made of plastic, is surrounded by a steel rod system 3 in order to increase its stability. In this connection, the container walls can certainly be configured to be double walls.

The IPC container according to FIG. 1 has an additional special tap hole 5, in addition to the openings 4 otherwise provided for filling, emptying, and washing, which is disposed in a depression 6 of the upper container wall 7. The depression 6 is made in the upper container wall 7 by means of deep-drawing; its dimensions, with regard to the maximal diameter and the maximally possible depth of the depression 6 that can be justified, are subject to narrow limits, for reasons of stability as well as reasons of production and tool technology.

As a result, in any case, the tap hole 5, the outside diameter of which is delimited by an eversion 10, lies lower as compared with the other upper container wall 7. Alternatively, the eversion 10 can also face inward, in other words into the interior of the container 1.

For both embodiments, it holds true that the pumping mechanism 11 accommodated in the tap hole 5, which essentially consists of a pump lance 12 with a rotor shaft 13 accommodated in this pump lance 12 and a transport channel 14 that concentrically surrounds this rotor shaft 13, does not project above the upper container wall 7 of the container 1. A fluid accommodated in the container 1, for example, preferably urea in the case of the SCR technology primarily being dealt with here, is supposed to be driven out of the container 1, in the direction of the tap hole 5, through the transport channel 14, by means of the pump rotor 15 driven by way of the rotor shaft 13.

In this connection, the pumping mechanism 11 projects above the tap hole 5, which is drawn deeper, around the connection connector piece 16, the upper edge of which, however, is clearly disposed below the upper container end 20 and below a closure 21 of the tap hole 5 that is provided for transport purposes, for example. The tap hole 5 is hermetically sealed, with regard to the outside environment, by means of a corresponding O-ring or sealing body 22.

The unit of a container 1 with a pumping mechanism 11 accommodated in this container, shown in FIG. 1, therefore represents a closed unit, completely sealed with regard to the atmosphere, which can easily be stacked, with the fluid accommodated in the container 1, in other words is capable of transport.

According to the representation in FIG. 3, the pump head 25, which can be released from the pumping mechanism 11, essentially consists of the connector flange 30 and the drive unit 31 accommodated in the pump head 25. According to the representation in FIG. 3, the removal connector piece 33 is provided with a union nut 32 for a connection with a pressure hose.

In an improved embodiment, however, the removal connector piece 33 is structured with a back-flow stop, in other words with a back-flow valve, for example, which opens automatically when the pump is in operation, and closes automatically when the pump head 25 is uncoupled, and thereby prevents return flow of any fluid still situated in the connected hose line. In this case, it is possible to do without the union nut 32, since the removal connector piece 33 is configured as a conventional hose plug for connecting a pressure hose.

When the pump head 25 is connected to the pumping mechanism 11 shown in FIG. 1 as intended, the drive motor 31 is coupled with the rotor shaft 13 of the pumping mechanism 11, with a force fit, and the removal connector piece 33 is set into a flow connection with the transport channel 14 disposed in the pump lance 12.

Since the connection of the pump head 25 to the pumping mechanism 11 is not pressure-free, it is necessary, in this connection, that the sealing means provided on the connection connector piece 16 of the pumping mechanism 11 in the region of the transition to the connector flange 3 are permanently pressed down by means of corresponding bias, particularly also by means of spring effect, maintaining the sealing effect, so that atmospheric pressure cannot penetrate into the container 1, and urea cannot penetrate out of the container 1.

FIG. 4 shows a container 1 with a container pump at least partially accommodated in the container. The container pump is introduced into the container 1 through a tap hole 5 of the container 1, which is drawn deeper. In this connection, the container pump consists essentially of a pumping mechanism 11 and a pump head 25. In this connection, the pumping mechanism 11 consists essentially of the pump lance 12 accommodated in the container 1, in which a continuous rotor shaft 13 is disposed, to drive a pump rotor 15 disposed in the region of the container bottom. In this connection, the pump rotor 15 is disposed on a pump foot 24 that stands on the container bottom. The pumping mechanism 11 projects above the tap hole 5 by a connection connector piece 16, whereby the connection connector piece 16 does not project above the container lid 7, due to the circumstance that the tap hole 5 is drawn deeper.

The pump head 25 having an integrated drive motor 31 is separably connected with the pumping mechanism 11, according to the representation in FIG. 4. The drive motor 31, usually a universal motor, is coupled with the pumping mechanism 11 by way of a connector flange 30, into which a removal connector piece 33 for connecting a pressure hose is integrated, in such a manner that for one thing, a force-fit connection of the drive motor 31 with the rotor shaft 13 exists, and furthermore, a pump dome 27 that penetrates the pump lance 12 stands in a flow connection with the removal connector piece 33. The said pump dome 27 represents the flow direction of the fluid accommodated in the container 1, for emptying. In this connection, the particularity should be pointed out that the connection connector piece 16 in turn is configured to be separable from the remaining pump head 25 with the integrated drive motor 31, whereby the connector flange 30 with the removal connector piece 33 integrated into it does not engage over the container lid 7 in the connected state. This is possible, in particular, because the removal connector piece 33 is disposed diagonally, in other words approximately at an angle of 135 degrees relative to the longitudinal expanse of the pump lance 12. This has the advantage that the removal connector piece 33 can be integrated into the tap hole 5, which has been drawn deeper, without the pressure hose to be connected with the removal connector piece 33, or with a usual hose coupling, having to be bent away.

When the pump head 25 and the pressure hose with the tap gun 34 connected with the pressure hose have been taken off, the container 1 with the integrated pumping mechanism 11 represents a sealed unit, and particularly a stackable unit. In this manner, IPC containers with an integrated pumping mechanism 11, for example, containing chemical or other fluids, can be transported in large numbers. These containers 1 with integrated pumping mechanism 11 can be used, for example, in order to deliver the urea required in connection with the introduction of the SCR technology at gas stations and/or shipping companies. The pump head 25 can then be set onto the connection connector piece 16 of the pumping mechanism 11 on site, in order to carry out filling of the tanks of utility vehicles with the reduction agents delivered by way of the containers 1, on site.

In this connection, it must be required that the container 1 with the integrated pumping mechanism 11 is sealed at the plant, in other words during transport. This seal must also be maintained at all times, also at the time of connection of the pump head 25, and of course must continue to exist when the tanks of the utility vehicles are filled. This is important if only because the reduction agents delivered with the container 1 can react with the atmosphere in undesirable manner, for example by means of crystallizing out.

According to the detail representation in FIG. 5, the pump foot 24 that stands on the container bottom is closed off with regard to the pump lance 12 that ends in the flow direction of the fluid to be emptied by means of a closure body 28. The pump lance 12 and the closure body 28 are penetrated, essentially concentrically, by the rotor shaft 13, which is connected with the pump rotor 15 so as to rotate with it. In this connection, the rotor shaft 13 is accommodated, on the rotor side, in a slide bearing bushing 29 that fulfills a dual function. For one thing, the slide bearing bushing 29 serves to mount the rotor shaft 13 on the rotor side, for another, however, the slide bearing bushing 29 also represents an actually undesirable flow channel for the fluid accommodated in the container 1. If no other provisions were made, the fluid driven towards the drive side by means of the pump rotor 15 would rise up in the shaft guide tube 26 through the slide bearing bushing 29, and could possibly exit on the drive side, in uncontrolled manner, if this were to happen.

The slide bearing bushing 29 is therefore dimensioned, in terms of its length and width, in such a manner that any fluid that might rise through the slide bearing bushing 29 loses its transport pressure over the length of the transport path formed by the slide bearing bushing 29, and therefore is pressureless when exiting from the slide bearing bushing 29, at the latest, whereby exit channels that exit radially outward follow the slide bearing bushing 29, by way of which the undesirable leakage flow flows back into the pump foot 24 or into the container 1.

In contrast, the fluid to be emptied is driven, as intended, by means of the pump rotor 15, through the transport channels in the closure body 28 not shown in detail in FIG. 5, into the pump dome 27 in the pump lance 12, which follows the closure body 28 in the flow direction.

On the basis of the embodiment of the pump foot 24 described above, the latter can be configured without any seal, to a great extent, so that the slide ring seal for the rotor shaft 13, i.e. the material glands used in this connection can be eliminated. The seal of the rotor shaft 13 on the drive side, with a slide ring seal or a material gland, would have the disadvantage, in each instance, of becoming increasingly non-tight over the course of time, and of leading to leakages. This is avoided with a sealless embodiment of the pump foot 24 according to FIG. 5.

Independent of the embodiment of the pump foot 24, however, it is necessary to seal the container 1 with the pumping mechanism 11 accommodated in the tap hole 5 towards the outside. This seal is evident from the detail representation in FIG. 6. According to the detail representation in FIG. 6, the pump lance 12 is closed off by an introduction connector piece 23 on the drive side. The introduction connector piece 23 is screwed onto the wall of the tap hole 5, in a manner not shown in greater detail here, with the interposition of a sealing ring 19.

The pump dome 27, which extends away within the introduction connector piece 23, is closed off, on the drive side, by means of a sealing body 22. In this connection, the sealing body 22 engages around the connection connector piece 16 of the pumping mechanism 11. Later, the pump head 25 is supposed to be able to be connected with the pumping mechanism 11, by way of the connection connector piece 16, in such a manner that the drive motor 31 is connected with the continuous rotor shaft 13, to drive it, with a force fit. The sealing body 22 is supplementally provided with an O-ring seal 8 that lies on the inside, which, together with the sealing body 22, is pressed down in the direction of the drive side, and therefore against a circumferential bevel 17 of the connection connector piece 16, by way of a pressure spring 9 that engages under the sealing body 22 on the rotor side, in such a manner that a residual flow channel that might exist between the connection connector piece 16 and the sealing body 22 that surrounds the connection connector piece 16 is securely closed off by means of the O-ring seal 8 that lies on the inside. In addition, the sealing body 22 has an O-ring seal 18 that lies on the outside, in order to close off a further residual flow channel that might remain between the sealing body 22 and the introduction connector piece 23.

As is also evident from FIG. 6, the rotor shaft 13 is guided in a shaft guide tube 26, within the pump dome 27, whereby, as was already explained above, it is effectively prevented, on the basis of the sealless embodiment of the pump foot, that a leakage flow is driven upward through the shaft guide tube 26, by means of the rotor. Nevertheless, because of the circumstance that the tap hole 5 is drawn deeper relative to the remaining container lid 7, there is the problem that the fluid level within the container 1 can lie above the upper edge of the tap hole 5. Usually, however, the fluid level within the shaft guide tube 26 rises to the height of the fluid level in the remaining container 1, independent of the operation of the container pump. In this regard, the fluid that stands in the shaft guide tube 26 is not pressureless on the drive-side opening of the shaft guide tube 26, so that it appears advisable to additionally seal the shaft guide tube 26 with one, preferably two shaft seal(s) 36, on the drive side, whereby these can, again, be O-ring seals, in each instance.

Since, however, the rotor shaft 13 necessarily extends completely through the connection connector piece 16 and therefore projects above the actual shaft guide tube 26, it has proven to be practical to additionally provide one, preferably two additional shaft seal ring(s) 37, 37' in the region of the sealing body 22. For the remainder, the rotor shaft 13 is also mounted with a ball bearing 38 in the region of the connection connector piece 16. In order to prevent the exit of possible residual leakages in the region of the bearing bushing of the ball bearing 38, the connection connector piece 16 is secured with at least one additional outside O-ring seal 40 in the region of the ball bearing 38.

According to the representation in FIGS. 5 and 6, it is therefore assured that the container 1 with integrated pumping mechanism 11 represents a completely sealed unit. According to the representation in FIG. 7, setting on the connector flange 30 with the integrated removal connector piece 33 also does not change this.

In this connection, the connector flange 30 is screwed together with the introduction connector piece 23 accommodated in the tap hole 5 by means of a bayonet closure, for example. In this connection, a connector cuff 39 that engages into the introduction connector piece 23 presses the sealing body 22 downward, overcoming the spring force of the pressure spring 9, in such a manner that the O-ring seal 8 that lies on the inside comes out of engagement, and thereby releases the flow channel from the flow channel out of the pump dome 27, which was previously closed off by means of the sealing body 22, with the help of the O-ring seal 8 that lies on the inside, in the direction of the removal connector piece 33. In this connection, the O-ring seal 18 that lies on the outside now takes over the seal of the connector cuff 39 with regard to the introduction connector piece 23. The rotor shaft 13 is mechanically connected with the drive unit accommodated in the pump head 25, by means of a coupling that is not of interest here.

According to the representation in FIG. 7, a mechanical and flow-technology coupling of the pump head 25 with the integrated removal connector piece 33 to the pumping mechanism 11, by way of the connector flange 30, comes about with the simple closure of a bayonet closure. In this connection, the seal of the container 1 is maintained at every point in time of the connection process.

Above, a container 1 with integrated pumping mechanism 11 is therefore described, which is configured as a completely sealed unit and can be provided, on site, by means of connecting the pump head 25 and, if applicable, a tap gun 34, for filling the tanks of vehicles or other vessels with the fluid accommodated in the container.

The solution described above is ideally suitable for filling the tanks of utility vehicles with the urea accommodated in the container, for implementation of the SCR technology.

It is felt to be particularly advantageous, in this connection, that the pumping mechanism 11 accommodated in the container 1 does not impair the stackability of the container, and therefore its transport, in any way. Another advantage, which supports the technology, lies in the fact that container 1 and pumping mechanism 11 form a sealed unit, which always remains sealed even at the time the pump head 25 is connected. The unit can be provided with a lead seal at the plant, for inspection purposes. In this way, the fluid accommodated in the container 1 is prevented from being exposed to the ambient air, or the fluid accommodated in the container 1 is prevented from exiting.

Usually, the gas stations required for implementation of the SCR technology can be implemented, in simple manner, in that the pump head 25 and the tap device are kept on hand, and only the containers in question, with integrated pumping mechanism 11 with the required urea are delivered, whereby the emptied containers are picked up again on this occasion.

Usually, the shipper will keep several containers on hand, in each instance, and orders appropriately filled containers as soon as he/she can predict that the last container in operation is being emptied.

REFERENCE SYMBOL LIST

1 container
2 container wall
3 steel grid
4 opening
5 tap hole
6 depression
7 upper container wall
8 O-ring seal that lies on the inside
9 pressure spring
10 eversion
11 pumping mechanism
12 pump lance
13 rotor shaft
14 transport channel
15 pump rotor
16 connection connector piece
17 circumferential bevel
18 O-ring seal that lies on the outside
19 sealing ring
20 upper edge of the container
21 closure
22 sealing body
23 introduction connector piece
24 pump foot
25 pump head
26 shaft guide tube
27 pump dome
28 closure body
29 slide bearing bushing
30 connector flange
31 drive motor
32 union nut
33 removal connector piece
34 tap gun
35 pressure hose

36 shaft seal
37 shaft sealing ring
37' shaft sealing ring
38 ball bearing
39 connector cuff
40 outside O-ring seal

The invention claimed is:

1. Container system having a pumping mechanism of a container pump, integrated into a container, which mechanism has a pump lance that can be introduced into the container through a tap hole, through which lance a rotor shaft releasably connected with a drive motor, having a pump rotor accommodated on the rotor shaft so as to rotate with it, extends, whereby the pump rotor is disposed at the end that is removed from a drive side of the rotor shaft, therefore is disposed in the bottom region of the container and having a pump head that can be separated from the pumping mechanism, wherein the pumping mechanism (11), separated from the pump head (25), is introduced into the tap hole (5) of the container (1) in such a manner that the container (1), with the pumping mechanism (11) introduced, forms a sealed unit, and the pump head (25) comprises a connector flange (30) for a force-fit and shape-fit connection of the pump head (25) to the pumping mechanism (11), whereby a removal connector piece (33) for connecting a pressure hose (35) for emptying the container (1) is integrated into the connector flange (30).

2. Container system according to claim 1, wherein the pumping mechanism is for a barrel or container pump.

3. Container system according to claim 1, wherein the drive motor (31) of the pump head (25) can be connected with the pumping mechanism (11), by way of the connector flange (30), in such a manner that the drive motor is coupled with the rotor shaft (13) with a force fit, and, at the same time, the removal connector piece (33) integrated into the connector flange (30) stands in a sealed flow connection with a transport channel (14) disposed in the pump lance (12).

4. Container system according to claim 3, wherein the connector flange (30) is a bayonet closure.

5. Container system according to claim 3, wherein the drive motor (31) is coupled to an extension of the rotor shaft (13) of the pumping mechanism (11), and the removal connector piece (33) extends away diagonally, from the longitudinal axis of the transport channel (14) disposed on the pump lance (12).

6. Container system according to claim 5, wherein the removal connector piece (33) extends away diagonally at an angle of approximately 135 degrees.

7. Container system according to claim 1, wherein the pumping mechanism (11) is accommodated in the tap hole (5) of the container (1) by means of a suitable sealing body (22), forming a seal, whereby the tap hole (5) is drawn deeper with regard to the remaining container wall (2), in such a manner that the connection connector piece (16) of the pumping mechanism (11) for the pump head (25) integrated into the container (1) does not project above an upper container wall.

8. Container system according to claim 7, wherein the sealing body is an O-ring seal; wherein the remaining container wall (2) is the upper container wall (7).

9. Container system according to claim 1, wherein the wall of the container (1) is configured with a double wall, and the outer container wall, in each instance, is drawn up, with regard to the inner container wall, to form an upper container wall (7), in such a manner that the tap hole (5) let into the inner container wall is laid deeper, in such a manner that the connector connection piece (16) of the pumping mechanism (11) integrated into the container (1) does not project above the upper container wall (7).

10. Container system according to claim 9, wherein when the pump head (25) is set onto the pumping mechanism (11) as intended, the removal connector piece (33) of the pump head (25) does not project above the upper container wall (7).

11. Container system according claim 1, wherein the drive motor (31) is separably connected with the connector flange (30) surrounding the removal connector piece (33).

12. Container system according to claim 1, wherein the drive motor (31) is a universal motor.

13. Container system according to claim 1, wherein at the same time when the pumping mechanism (11) is connected to the pump head (25), a seal that closes off the transport channel (14) in the direction of the drive motor (31) is automatically opened.

14. Container system according to claim 13, wherein the closure is a bayonet closure of the connector flange (30).

15. Container system according to claim 1, wherein the removal connector piece (33) is provided with a back-flow lock, for connecting the pressure hose (35).

16. Container system according to claim 15, wherein the back flow lock is a kick-back valve.

17. Container system according to claim 1, wherein the container (1) with integrated pumping mechanism (11) is secured against unauthorized removal of the fluid accommodated in the container (1), by means of a lead seal.

18. Container system having a pumping mechanism (11) of a container pump, integrated into a container (1), which mechanism has a pump lance (12) that can be introduced into the container (1) through a tap hole (5), through which lance a rotor shaft (13) releasably connected with a drive motor (31), having a pump rotor (15) accommodated on the rotor shaft so as to rotate with it, extends, whereby the pump rotor (15) is disposed at the end that is removed from a drive side of the rotor shaft (13), therefore is disposed in the bottom region of the container (1), and having a pump head (25) that can be separated from the pumping mechanism (11), wherein the pump head (25) can be separated from the pumping mechanism (11) in such a manner that the pumping mechanism (11) integrated into the container (1) forms a sealed unit with the container (1), whereby the pump lance (12) of the pumping mechanism (11) is introduced into a tap hole (5) of the container (1), and the tap hole (5) is sealed off by means of a sealing body (22), which surrounds a connection connector piece (16) that follows the pump lance (12) on the rotor side, forming a seal; wherein the sealing body (22) has at least one O-ring seal (8) that lies on the inside, whereby this sealing body (22) is pressed against a circumferential bevel (17) of the connection connector piece (16) by means of a pressure spring (9), disposed on the rotor side, in such a manner that this O-ring seal (8) that lies on the inside closes off a leakage flow channel that might open.

19. Container system according to claim 18, wherein the pump is a barrel or container pump; and wherein the pressure spring is a helical spring.

20. Container system according to claim 18, wherein the sealing body (22) is surrounded by at least one O-ring seal (18) that lies on the outside, which surrounds a possible flow channel between an introduction connector piece (23) surrounding a sealing ring (19), of the connection connector piece (16) that is accommodated in the tap hole (5) of the container (1).

21. Container system according to claim 18, wherein the pumping mechanism (11) at least essentially consisting of the connection connector piece (16), an introduction connector piece (23) for a connection of the tap hole (5) of the container (1), and the pump lance (12) with final pump foot (24), is penetrated by the continuous rotor shaft (13), disposed concentrically in the pump lance (12), which shaft is enclosed by a shaft guide tube (26) at least approximately over its entire length, whereby the shaft guide tube (26) in turn is surrounded by a pump dome (27) essentially forming the flow channel for the fluid to be removed from the container (1), which dome is closed off, in sealed manner, on the drive side, by the sealing body (22) with O-ring seals (8, 18) that lie on the inside and on the outside.

22. Container system according to claim 18, wherein a pump foot (24) that essentially accommodates the pump rotor (15) is structured to be sealless, at least to a great extent.

23. Container system according to claim 21, wherein the pump foot (24) is provided with flow inlets for entry of the container fluid that surrounds the pump foot (24), and this pump foot (24) is closed off by a closure body (28) that closes off the pump lance (12) on the drive side, whereby this closure body (28) is penetrated concentrically by the rotor shaft (13), and transport channels that are flow-connected with the pump dome (27) situated in the pump lance (12) are let into this closure body (28) in the vertical flow direction.

24. Container system according to claim 23, wherein the rotor shaft (13) is mounted with a slide bearing on the power take-off side, in the region of the closure body (28), whereby the fluid accommodated in the container (1) flows through a bearing bushing (29) of the slide bearing, depending on the fill level of the container (1), whereby the length and width of the slide bearing bushing (29) are dimensioned in such a manner that any fluid exiting from the slide bearing bushing (29) on the drive side is pressureless, at least to a great extent, and furthermore enters into exit channels of the closure body (28) that point radially outward, and flows back into the pump foot (24) or the container (1) in the further course of flow.

25. Container system according to claim 18, wherein a shaft guide tube (26) surrounding the rotor shaft (13) is sealed off, on the drive side, by means of at least one, shaft seal (36), in the direction of the drive side.

26. Container system according to claim 25, wherein there are two shaft seals (36).

27. Container system according to claim 18, wherein the rotor shaft (13) additionally mounted in the region of the connection connector piece (16) by means of a ball bearing (38) is additionally sealed off in the region of the sealing body (22) by means of one, shaft sealing ring (37, 37').

28. Container system according to claim 27, wherein there are two shaft sealing rings (37, 37').

29. Container system according to claim 18, wherein the tap hole (5) of the container (1), closed off by means of the sealing body (22) and an introduction connector piece (23), is permanently sealed during and after connection of the pump head (25) by way of a connector flange (30), in that the connector flange (30) is connected to the sealing body (22), overcoming the spring force of LhC a pressure spring (9) that engages under the sealing body (22) on the rotor side, which spring is pressed axially downward when this happens, so that in this way, the O-ring seal (8) that lies on the inside, of the sealing body (22) that engages over the connection connector piece (16), is set out of engagement, and therefore the flow channel from a pump dome (27) of the pumping mechanism (11) to the removal connector piece (33) integrated into the connector flange (30) is opened, whereby at the same time, an O-ring seal (18) that lies on the outside surrounds a connector cuff (39) of the connection connector piece (16), forming a seal, in such a manner that any flow path that might open between connector cuff (39) of the connection connector piece (16) of the pumping mechanism (11) and the introduction connector piece (23) of the connector flange (30) of the pump head (25) is closed.

30. Container system according to claim 29, wherein at least one additional outside O-ring seal (40) is provided in the connector flange (30) of the pump head (25), at the height of the ball bearing (38) of the rotor shaft (13), which closes off the flow channel opened up approximately in the region of the ball bearing of the rotor shaft (13) and the surrounding connector flange (30).

31. Container system according to claim 30, wherein the connector flange (30) of the pump head (25) can be connected with the connection connector piece (16) of the pumping mechanism (11), by means of a bayonet closure, in such a manner that a flow connection from the pump dome (27) of the pump foot (24) to the removal connector piece (33) of the connector flange (30) is opened up, and, at the same time, a force-fit connection of the drive motor (31) accommodated in the pump head (25) with the rotor shaft (13) of the pumping mechanism (11) exists.

* * * * *